US005170091A

United States Patent [19]

Wekhof

[11] Patent Number: 5,170,091

[45] Date of Patent: Dec. 8, 1992

[54] LINEAR ULTRAVIOLET FLASH LAMP WITH SELF-REPLENISHING CATHODE

[75] Inventor: Alexander Wekhof, Emeryville, Calif.

[73] Assignee: Ultraviolet Energy Generators, Inc., Oakland, Calif.

[21] Appl. No.: 626,121

[22] Filed: Dec. 10, 1990

[51] Int. Cl.[5] ..... H01J 17/08

[52] U.S. Cl. ..... 313/163; 313/573; 313/634; 313/612

[58] Field of Search ..... 313/163, 172, 565, 573, 313/634, 612; 315/112

[56] References Cited

U.S. PATENT DOCUMENTS

| | | | |
|---|---|---|---|
| 749,793 | 1/1904 | Hewitt | 313/612 |
| 1,075,615 | 10/1913 | Weintraub | 313/163 |
| 1,110,552 | 9/1914 | Hewitt | 313/612 |
| 1,110,555 | 9/1914 | Hewitt | 313/612 |
| 1,110,985 | 9/1914 | Bastian | 313/612 |
| 1,116,480 | 11/1914 | Podszus | 313/612 |
| 2,210,674 | 8/1940 | Knowles | 313/565 |
| 2,265,362 | 12/1941 | Elenbaas et al. | 313/565 |
| 2,307,502 | 1/1943 | Gordon et al. | 315/112 |
| 2,459,199 | 1/1949 | Stutsman | 313/565 |
| 4,156,826 | 5/1979 | Hernqvist | 313/565 |
| 4,295,074 | 10/1981 | Ragland, Jr. | 313/565 |
| 4,349,765 | 9/1982 | Brandli | 313/565 |

*Primary Examiner*—Donald J. Yusko
*Assistant Examiner*—John Giust
*Attorney, Agent, or Firm*—Townsend and Townsend

[57] ABSTRACT

A noble-gas flashlamp having a self-replenishing mercury-pool cathode. The lamp includes a lamp envelope which is transparent to UV radiation and which forms a linearly extending discharge chamber for holding a noble gas discharge material. At the cathode end of the discharge chamber the envelope forms a cavity or bubble communicating with the discharge chamber. The cathode of the lamp is formed by a cathode electrode and a pool of liquid mercury in the cavity. The electrode is both electrically and thermally conducting, and the pool of liquid mercury covers the electrode and is in heat exchange relation with the electrode in the cavity. For enhanced heat transfer the cathode electrode extends beyond the lamp envelope so that it may be brought into direct contact with the lamp coolant material. The anode comprises an electrically and thermally conducting anode electrode at said anode end of the discharge chamber. The anode may also be formed with a cavity or bubble in the lamp envelope surrounding the anode electrode and with a much heavier than conventional heat sink in the form of a heavy tungsten rod protruding beyond the lamp envelope so that it may also be brought into direct contact with the lamp coolant material.

1 Claim, 5 Drawing Sheets

LINEAR ULTRAVIOLET FLASH LAMP WITH SELF-REPLENISHING CATHODE

BACKGROUND OF THE INVENTION

The present invention relates to linear flash lamps for the generation of ultraviolet (UV) light, particularly in the deep UV region of the spectrum.

Although linear flash lamps are widely used in many different applications, in practice they find only limited use as generators of deep UV light. The generation of radiation in this part of the spectrum with such lamps requires that the lamps be run at high current densities, and this leads to a drastic reduction in lamp lifetime. For example, a xenon flash lamp with a bore diameter of 6 millimeters and a length of 6 inches is normally run at a current density of 1 to 2 kiloamperes per square centimeter (kAmp/cm$^2$) and has a lifetime of a few hundred million pulses. At current densities of about 8 kAmp/cm$^2$ the lifetime is reduced by a factor of about 1000—to about 500,000 pulses,—which makes the generation of deep UV radiation with conventional lamps commercially impractical.

SUMMARY OF THE INVENTION

The present invention provides an improved linear flash lamp, which is especially suited for the generation of continuum and dense line radiation in the deep UV spectrum at significantly greater efficiency than conventional flash lamps at the same "elevated" electrical conditions and which overcomes the limitations on lamp lifetime in known flash lamps.

Briefly, a lamp according to the invention includes a lamp envelope which is transparent to UV radiation and which forms a linearly extending discharge chamber for holding a noble gas discharge material. At the cathode end of the discharge chamber the envelope forms a cavity or bubble communicating with the discharge chamber. The cathode of the lamp is formed by a cathode electrode and a pool of liquid mercury in the cavity. The electrode is both electrically and thermally conducting, and the pool of liquid mercury covers the electrode and is in heat exchange relation with the electrode in the cavity. For enhanced heat transfer the cathode electrode extends beyond the lamp envelope so that it may be brought into direct contact with the lamp coolant material. The anode comprises an electrically and thermally conducting anode electrode at said anode end of the discharge chamber. The anode may also be formed with a cavity or bubble in the lamp envelope surrounding the anode electrode and with a much heavier than conventional heat sink in the form of a heavy tungsten rod protruding beyond the lamp envelope so that it may also be brought into direct contact with the lamp coolant material. The cathode area and the rest of the lamp are cooled to maintain the temperature of the mercury pool in the range of 10 to 20 degrees Centigrade and to prevent the lamp walls and the anode area from overheating. It is an advantage of the invention that the mercury pool with its immersed electrode forms a self-replenishing cathode for the flash lamp and gives the lamp a significantly longer lifetime and significantly greater power output in the far UV spectral range than conventional lamps.

Other aspects, advantages, and novel features of the invention are described below or will be readily apparent to those skilled in the art from the following specifications and drawings of an illustrative embodiment.

DETAILED DESCRIPTION OF ILLUSTRATIVE EMBODIMENTS

Figure 1:
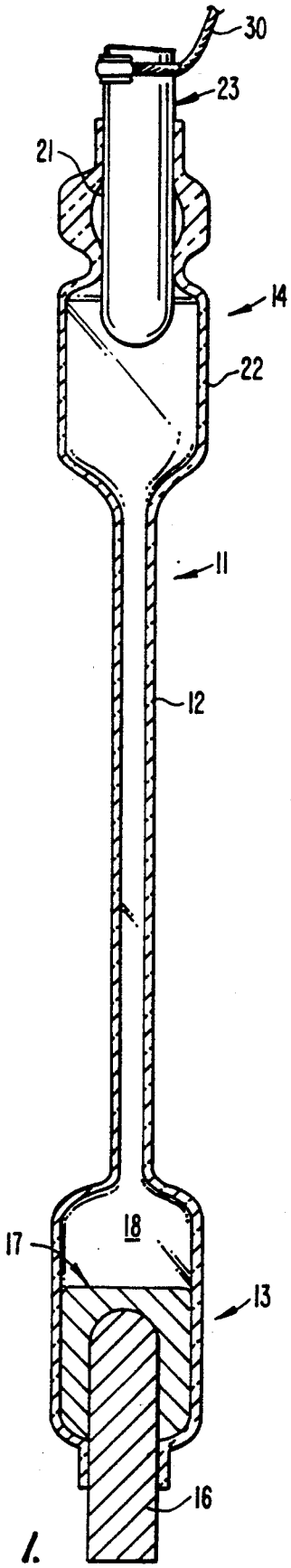
FIG. 1 is a cross-sectional view of a flash lamp according to the invention.

FIG. 1 shows an overall view of an illustrative flash lamp according to the invention. The flash lamp includes an outer envelope 11 of a material such as quartz transparent to UV radiation. The central region of envelope 11 defines a linearly extending discharge chamber 12, which is shown in FIG. 1 as of generally cylindrical shape, although other shapes may also be used. Discharge chamber 12 contains a gas such as xenon for supporting a plasma or gas discharge, which under operating conditions will contain an admixture of mercury ions, as discussed more fully below. Disposed at the ends of discharge chamber 12 are a cathode 13 and anode 14.

Cathode 13 comprises a central electrode 16 and a pool of liquid mercury, indicated generally at 17. Electrode 16 is shown in FIG. 1 in the shape of a rod and is fabricated of a material having high electrical and thermal conductivity. Tungsten has been found to be a suitable material for use in the present invention. Envelope 11 is shaped to define a cavity or reservoir 18 in the vicinity of electrode 16 for liquid mercury 17. The walls of cavity 18 are spaced apart from electrode 16 so that at least the tip of the electrode is completely immersed in the liquid mercury.

Constructed in this manner, the mercury pool in cavity 18 forms a self-replenishing cathode, which operates to extend the lifetime of the flash lamp. In conventional flash lamps the lamp life is limited by two mechanisms: (a) by a transfer to the inner lamp walls of the sputtered cathode material and (b) by deterioration of the quartz envelope, mostly in the vicinity of the cathode, due to thermal and shock waves generated by the pulsations of the gas discharge. In conventional lamps the combined action of these effects increases with the lamp current density. In the present lamp, however, both these mechanisms are greatly reduced. In fact, the sputtering of the liquid mercury cathode (and also evaporation of the liquid mercury) does not result in a permanent transfer of mercury atoms to the lamp inner walls because mercury does not adhere to heated quartz. Thus, mercury atoms build up in the discharge to the equilibrium pressure, when the flow of mercury atoms sputtered is equal to the flow recaptured by the mercury pool. As to the other mechanism, the shock and thermal waves are dissipated over a much larger cathode area than in conventional lamps.

To achieve the self-replenishing action the liquid mercury cathode must be maintained at a relatively low temperature compared with the plasma discharge. When properly cooled the liquid mercury cathode recaptures sputtered mercury from the gas discharge to replenish itself and does not build much pressure inside the lamp. It has been found that a temperature on the order of 20 degrees centigrade or lower will suffice. The liquid mercury pool is maintained at the low temperature through a water-cooled heat sink (not shown). The structure and operation of heat sinks is within the ordinary skill in the art and need not be described in detail here. The tungsten electrode 16 serves to remove heat from the liquid mercury pool. The heat removing function of electrode 16 is highly effective because the tungsten rod extends from inside cavity 18, where it is immersed in the mercury pool, to the area outside the lamp envelope, where it is directly cooled by the coolant.

The use of tungsten for the cathode heat sink is highly desirable. Since electrode 16 conducts electric current as well as heat, there is a tendency for minor microscopic sparking to occur at the boundary of the electrode with the mercury pool. Such minor sparking in turn causes sputtering and transfer of the electrode material through the mercury pool into the lamp walls. The use of tungsten as the electrode material has been found to greatly suppress this effect. It is important that only the mercury pool be exposed directly to the plasma discharge, not the tungsten conductor.

To reduce the effects associated with high current densities in the vicinity of the cathode and to insure a sufficient surface area of mercury for recapturing sputtered mercury, the diameter of the mercury pool should be two or more times larger than the diameter of discharge chamber 12 (the lamp bore diameter). For a typical average electrical load on the lamp of 1 kilowatt of pulsed power plus 0.3 kilowatts of DC power for a simmer current (see the description of the electrical operation below), the ratio of bore diameter to mercury pool diameter should be on the order of 1:3. For larger power input to the lamp this ratio may be scaled proportionately, or the optimum ratio may be established through empirical tests with lamps of different geometries. In such empirical testing, splashing and bubbling of the mercury surface indicate an overload of electrical current for the given geometry and amount of cooling. Failure to provide a sufficiently large mercury surface for recapture of sputtered and evaporated mercury could result in a buildup of the mercury vapor pressure in the lamp with possible destructive consequences.

The anode for the lamp may also differ from conventional ones. In conventional flash lamps the anode is typically provided by a thin tungsten rod which is gripped tightly around the cylindrical surface of the rod by the lamp envelope and the rod is connected to the lamp's anode cup through a thin electrical connection. The conventional tungsten rod anode is thin so that only a small area at the end of the rod faces into the discharge chamber. During operation of the lamp, the tungsten anode becomes quite heated to the degree that the anode is not sufficiently cooled by a regular water cooling flow. As a result, the inner portion of the quartz envelope around the anode is also elevated to a high temperature, much higher than that of quartz walls inside the lamp. If the quartz temperature is too high, then mercury present in the lamp discharge penetrates into the wall (unlike deflecting from the wall at a lower temperature). Hence, it becomes impregnated in the quartz crystal structure at the end of the discharge chamber in the vicinity of the anode. This mercury contamination of the quartz envelope alters the transparency properties of the lamp envelope with respect to ultraviolet radiation. The lamp envelope takes on a dark green hue around the anode making that end of the discharge tube unusable for effective transmission of UV radiation, thereby diminishing the effective UV emissions.

In the present invention anode 14 is provided by electrically and thermally conducting electrode 21, which is shown in the form of a cylindrical tungsten rod the same as electrode 16. To assist in the distribution of heat from anode 14, lamp envelope 11 is shaped to form a cavity or bubble 22 about electrode 21. The outer or distal end 23 of anode 14 extends beyond lamp envelope 11 to the exterior of the lamp so that the anode may be cooled directly, for example, by direct contact with a suitable coolant. The inner or proximal end of anode 14 extends into bubble 22, much as the proximal end of electrode 16 extends into the mercury reservoir 18.

Structured in this way, the present invention is able to counteract the obscuring of the lamp envelope in several different ways. First, bubble 22 around tungsten rod 21 serves to space the envelope apart from the anode in the vicinity of the discharge chamber and this serves to decrease the direct transfer of heat from the rod to the lamp envelope. Second, the tungsten rod has a diameter on the order of, or somewhat larger than, the central bore of discharge chamber 12. Consequently, the rod presents a greater surface area at its face to the discharge, and this increases the direct heat transfer from the discharge to the rod. Third, the tungsten rod is formed to extend into the interior region of bubble 22 so that the sides of the rod within the bubble also participate in the heat transfer. Fourth, because the distal end of rod 21 is formed to protrude beyond the lamp envelope, the rod may be extended directly into the water flow for enhanced cooling. An extension on the order of at least 1 inch (2.5 cm) has been found to be an effective amount. Fifth, the anode is subjected to substantially increased water cooling over that commonly used with conventional anodes. Sufficient water cooling of the anode may be obtained, for example, with a flow of water around the lamp at the rate of at least about 2 liters per minute with the water temperature not exceeding 12 degrees Centigrade.

An effective lamp according to the invention may be constructed with the following dimensions. The discharge chamber is generally cylindrical in shape with a bore diameter of 7 to 9 mm and a length of 150 to 250 mm. The tungsten electrodes 16 and 21 have a diameter of 10 mm. The bubbles 18 and 22 have a diameter of 20 to 23 mm, and the electrodes 16 and 21 extend 25 mm beyond the lamp envelope.

The lamp may be mounted in conventional sockets. However, for reducing mechanical stress on the lamp envelope, the anode terminates in a flexible wire 30, which is secured to the end of the anode electrode 21, for example, by clamping. When the anode is held in position by this flexible wire, the lamp envelope does not experience mechanical stresses usually associated with a firm lamp mounting. It is important to eliminate extraneous sources of stress from the lamp, which is already subjected to stress from the high-powered pulsing.

As shown in FIG. 1 the flash lamp may conveniently be configured so that linearly extending discharge chamber 12 and the elongate electrodes 16 and 21 are co-linear with one another. This configuration is especially suited for vertical operation.

Figure 2:
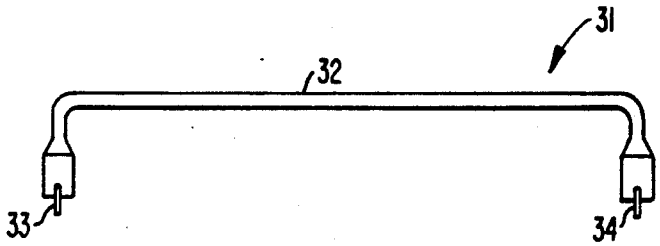
FIG. 2 is a cross-sectional view of an alternative embodiment according to the invention.

FIG. 2 shows an alternative embodiment suited for horizontal operation. In this embodiment the lamp envelope 31 is formed with right-angle bends at the ends of discharge chamber 32 so that the elongate electrodes 33 and 34 at the cathode and anode ends of the lamp run perpendicular to the linearly extending discharge chamber. In this embodiment the cathode and anode are also formed with bubbles in the lamp envelope as described above. In operation, the lamp is oriented with the discharge chamber in horizontal disposition and the anode and cathode running vertically so that the liquid mercury pools in the cavities formed by the bubbles. Although illustrated in FIG. 2 with both anode and cathode ends perpendicular to the discharge chamber, the lamp may also be configured with only the cathode end perpendicular to the discharge chamber while the anode end remains in line with the discharge chamber as described in connection with FIG. 1. The horizontal lamp embodiment may be constructed with a discharge chamber from 6 to 30 inches long or more.

The horizontal embodiment of FIG. 2 provides two additional features. The UV output may be enhanced by using a triangular-shaped tube for the horizontal discharge chamber oriented in a way that are one of the corners of this triangle body is in the uppermost position. It is found that due to the specific plasma confinement conditions existing in a triangular bore, the discharge plasma is subjected to a stronger compression and this results in a higher UV output over the output achieved under comparable conditions in a cylindrically shaped horizontal discharge chamber. In the deep UV region of the spectrum the output with the triangular discharge chamber may be increased by approximately 25 percent over the output in that spectral region in a cylindrical horizontal discharge chamber.

Another advantage of the horizontally disposed embodiment of the flashlamp with a mercury pool cathode is that the lamp may be formed with two mercury-pool electrodes as illustrated in FIG. 2 on opposite sides of the horizontal discharge tube. This permits the lamp to be used as a high-power medium-pressure mercury lamp with considerably longer lifetime than conventional medium-pressure mercury lamps. The lifetime of conventional medium-pressure mercury lamps typically does not exceed 1000 hours due to destruction of the electrodes, both of which operate in an AC circuit as cathode and anode, switching their roles in each AC cycle. The self-replenishing mercury electrodes can withstand standard loads typical for medium pressure mercury lamps, but they will not wear out with time. The spectra of such lamps are found to be very close to the spectra of conventional medium-pressure mercury lamps.

Figure 3:
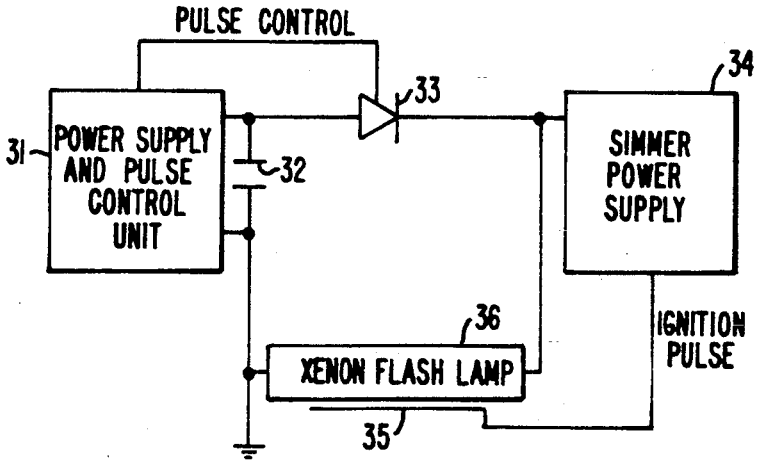
FIG. 3 is a block schematic diagram of an electrical circuit for use with the flash lamps of FIGS. 1 and 2.

FIG. 3 shows a block electrical schematic diagram of a power supply and switching circuit arrangement for operating the flash lamp. The circuit includes a power supply and pulse control unit 31, charging capacitor 32, silicon controlled rectifier (SCR) 33, simmer power supply 34 and ignition wire 35. The flash lamp is shown at 36. Charging capacitor 32 typically has a capacitance on the order of 4 microfarad and power supply 31 provides a charging voltage in the range of 2 to 5 kiloVolts (kV). The network operates to produce a small DC current (2 to 3 amperes) through flash lamp 36 (the so-called simmer current). The voltage across lamp 36 corresponding to this DC current will typically be about 100 Volts once the simmer current is established. To establish the simmer current, an initial voltage of about 1.5 kV DC is applied to the lamp, and the lamp is ignited with a high voltage spark through ignition wire 35. As soon as the simmer current is established, SCR 33 can be opened periodically to discharge the capacitor into lamp 36.

The lamp has two spectra. One is the pulsed spectrum generated when the lamp is operated in the pulsed mode, and the other is the simmer spectrum, which is the spectrum of the simmer DC discharge and which corresponds to the spectrum generated in the time between pulses. It is necessary to use a simmer to sustain DC current of about 2.5 to 3.5 Amperes in the lamp, so that each time SCR 33 is open the energy goes into an already existing wide open discharge channel in the middle of the lamp shell along its axis. This prevents shock waves and quartz thermal deterioration. While it is common for flashlamps to run simmer DC between pulses, conventional flashlamps do not generate any usable UV in this mode. Viewing the lamp as a UV generator, this electrical energy is considered lost. In the present case, however, the simmer DC discharge generates strong UV lines comparable to those of medium pressure mercury lamps. (See FIG. 5.) This effect can be enhanced by running a higher DC current through the lamp to the extent that the lamp can be uniquely used as a medium pressure mercury lamp with extended lifetime.

Figure 5:
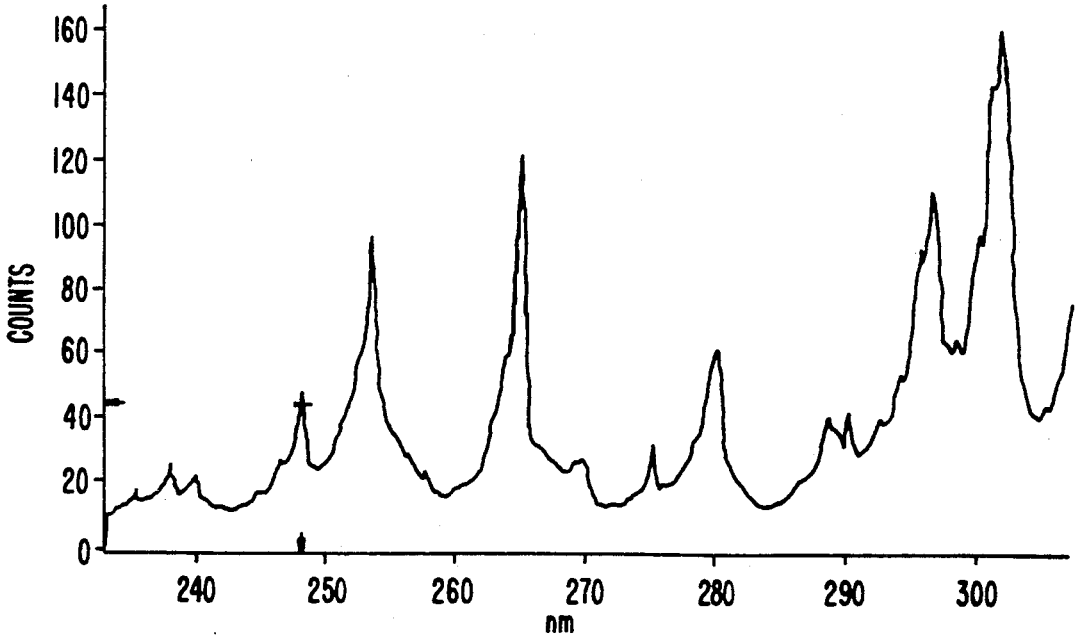
FIG. 5 shows the lamp spectrum for a conventional medium-pressure mercury lamp.
Figure 4A:
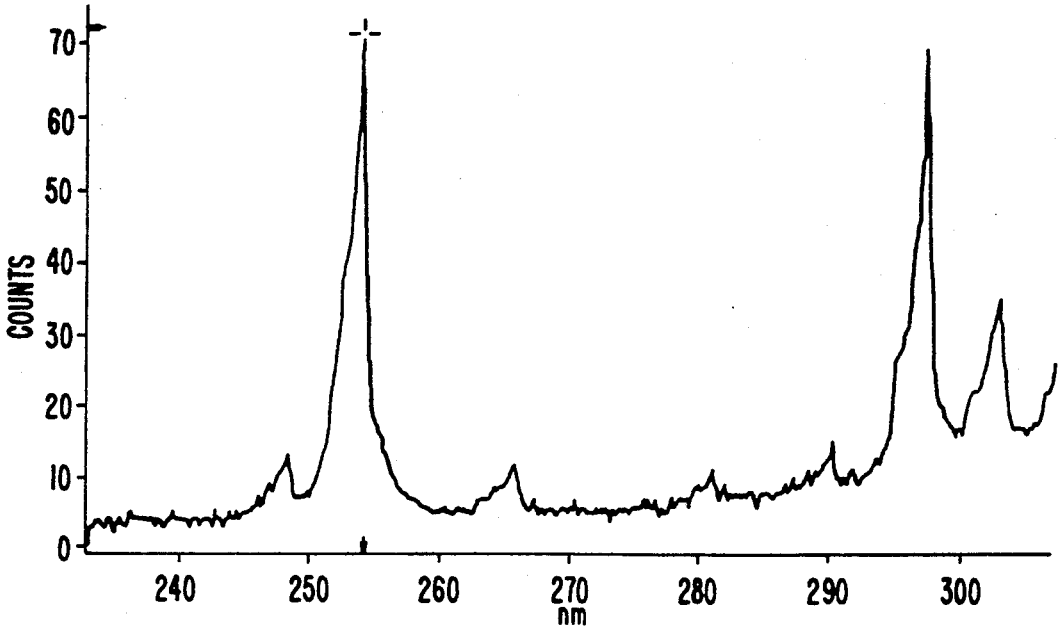
FIGS. 4A and 4B show the observed spectra of xenon flash lamps according to the invention and of conventional construction, respectively, operating in simmer mode only.
Figure 4B:
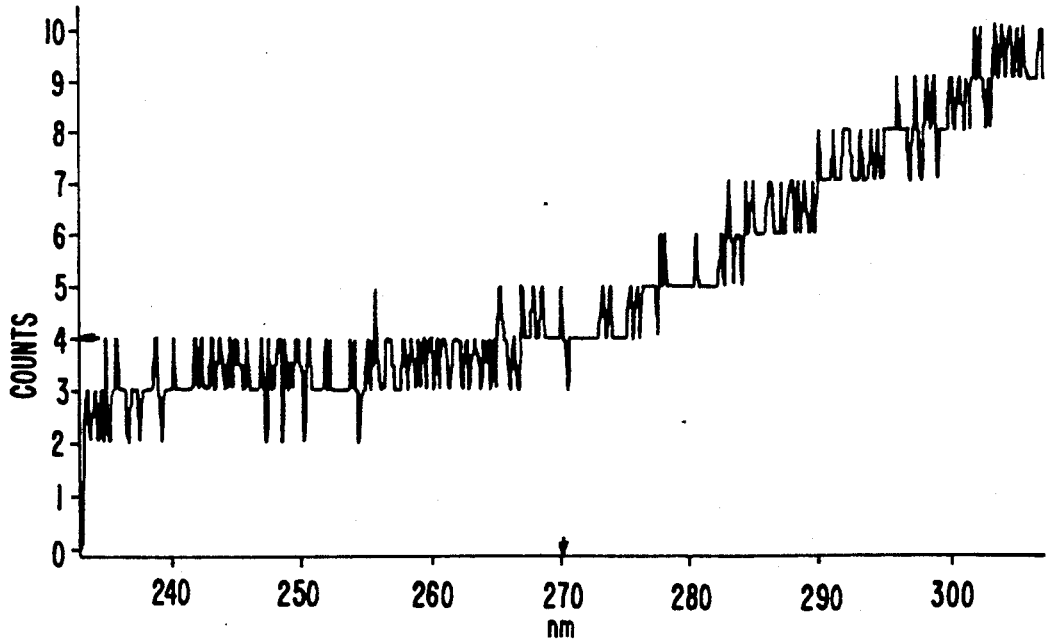

FIGS. 4A and 4B show the lamp spectra for a xenon flash lamp according to the present invention (FIG. 4A) and a conventional xenon flash lamp (FIG. 4B) operating in simmer mode with a simmer current of 2.5 Amps. FIG. 5 shows the lamp spectrum for a conventional medium-pressure mercury lamp. Note that the simmer mode for the regular xenon flashlamp does not generate practically any UV radiation in the far UV. By contrast, the far UV radiation generated with the lamp of the present invention operating in the simmer mode compares favorably to that generated by a conventional medium-pressure mercury lamp.

Figure 6A:
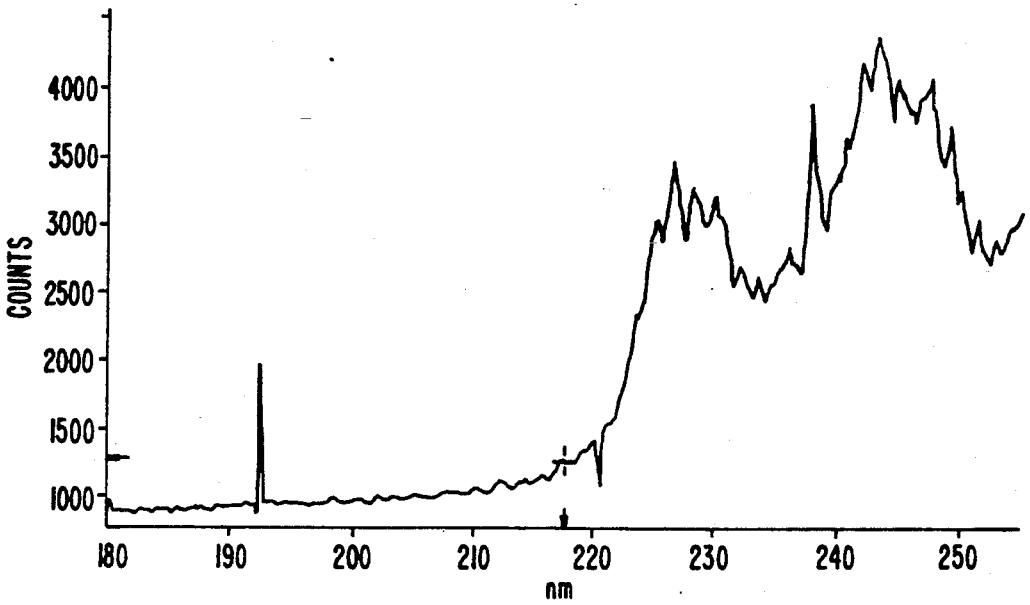
FIGS. 6A and 6B show the spectra under pulsed operation for a xenon flash lamp according to the invention in the two spectral ranges of 180 to 250 nm (FIG. 6A) and 230 to 310 nm (FIG. 6B).
Figure 6B:
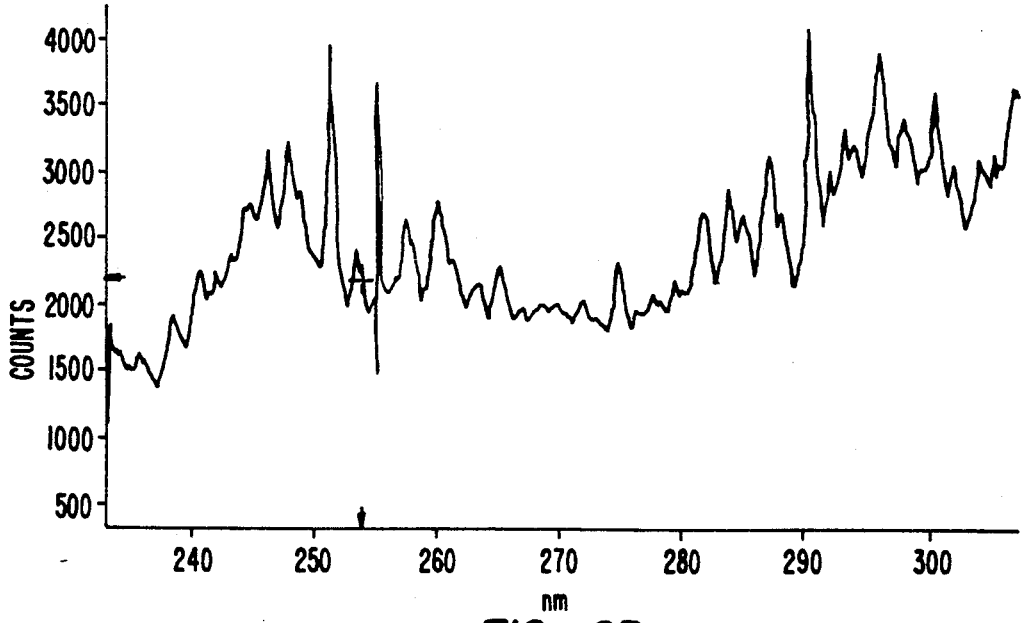

FIGS. 6A and 6B show the spectra under pulsed operation for a xenon flash lamp according to the invention in the two spectral ranges of 180 to 250 nm (FIG. 6A) and 230 to 310 nm (FIG. 6B). The corresponding spectra for a conventional xenon flash lamp are shown in FIGS. 7A and 7B.

The description of these spectra is assisted by first describing the phenomena in the lamp during pulsing. Mercury atoms sputtered from the mercury pool cathode become ionized in the plasma discharge. The mercury ions contribute to a much stronger UV emission in both the line spectrum and the continuum because such emission is proportional to the atomic weight of the emitting ions and mercury is almost twice as heavy as Xenon (their atomic weights are 200 and 131, respectively).

Figure 7A:
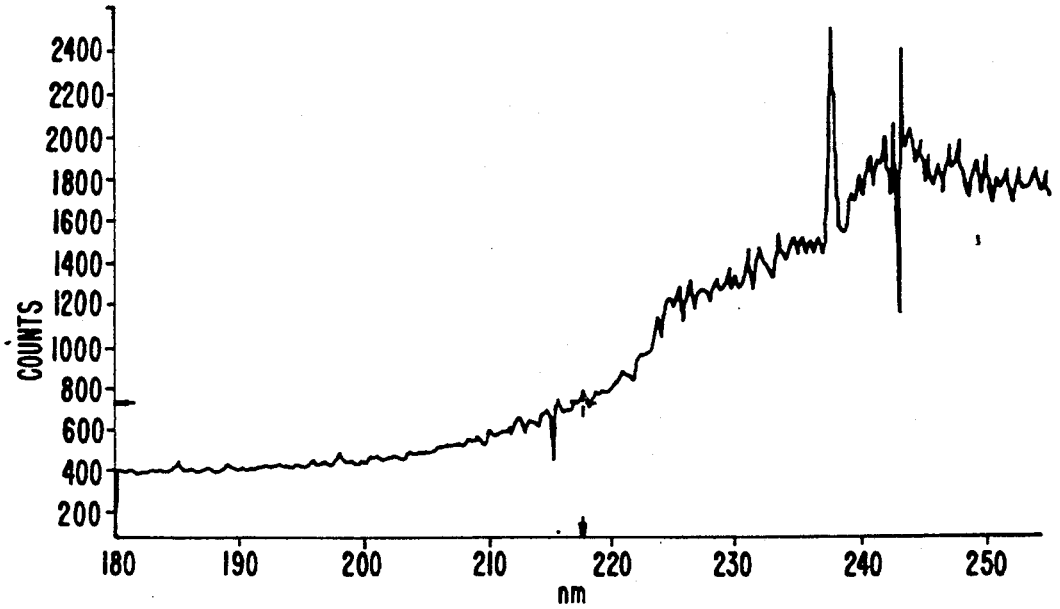
FIGS. 7A and 7B show the spectra for a conventional xenon flash lamp in the same ranges and under the same operating conditions as in FIGS. 6A and 6B.
Figure 7B:
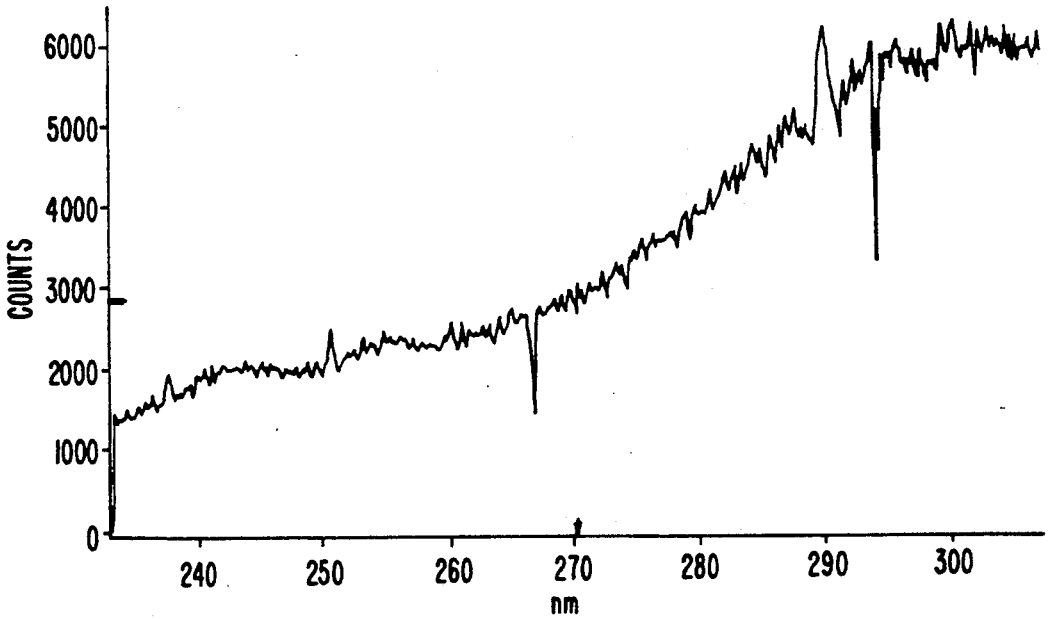

The conventional-lamp spectra of FIGS. 7A and B were taken with a flashlamp having the best available quartz (suprasil) envelope, while those of FIGS. 6A and B were taken for a lamp according to the invention constructed with an inferior grade quartz envelope. The other test parameters were the same for both lamps:

a. the same basic lamp geometry (i.e., the same bore diameter and the same distance between electrodes);

b. the same electrical operating conditions (14 microsecond electrical pulse duration; peak current of 1800 Amperes; energy per pulse of 18 Joules; capacitor voltage of 3000 Volts).

c. the same distance from the spectrometer (six inches).

Looking at these spectra, one can see an immediate difference where spectra for a regular flash lamp show about half as much UV output in the deep UV region as the lamp according to the invention. That is to say, the present lamp generates about 50 percent more UV as a conventional xenon flashlamp of comparable geometry at the same operating conditions. In addition, it delivers a strong UV emission from the simmer mode while the same electrical energy spent on simmer in a regular xenon flashlamp is effectively lost.

The above provides a description of illustrative embodiments of the invention. Given the benefit of this description, various modifications and alternate configurations will occur to those skilled in the art, not all of which can be conveniently described herein. Accordingly, the invention is not intended to be limited only to the specific examples and embodiments disclosed herein, but is defined by the appended claims.

What is claimed is:

1. A flash lamp for generating ultraviolet (UV) radiation comprising:

a lamp envelope transparent to UV radiation formed to define a linearly extending discharge chamber, said chamber having a cathode end and an anode end, and said envelope being further formed to define a first cavity at said cathode end communicating with said discharge chamber;

a cathode comprising a cathode electrode disposed at said first cavity, said electrode being both electrically and thermally conducting, and a pool of liquid mercury covering said cathode electrode such that said cathode electrode disposed at said first cavity is completely immersed in said pool of liquid mercury and in heat exchange relation therewith in said first cavity; and an anode comprising an electrically and thermally conducting anode electrode at said anode end of said discharge chamber;

wherein said cathode and anode electrodes are in the form of elongate rods, said discharge chamber has a characteristic diameter and said elongate rods have a diameter not less than said discharge chamber characteristic diameter.

* * * * *